US005887475A

United States Patent [19]

Muldner

[11] Patent Number: 5,887,475

[45] Date of Patent: Mar. 30, 1999

[54] MATERIAL FOR PROTECTING SHEET METAL DURING THE SHEET METAL FORMING PROCESS

[76] Inventor: James Scott Muldner, 18581 Wildflower Dr., Penn Valley, Calif. 95946

[21] Appl. No.: 359,529

[22] Filed: Dec. 20, 1994

Related U.S. Application Data

[63] Continuation-in-part of Ser. No. 208,974, Mar. 9, 1994, Pat. No. 5,542,282.

[51] Int. Cl.[6] ..... B21D 5/02

[52] U.S. Cl. ..... 72/379.2; 72/389.3; 72/465

[58] Field of Search ..... 72/57, 63, 389.3, 72/414, 465, 379.2

[56] References Cited

U.S. PATENT DOCUMENTS

| | | | |
|---|---|---|---|
| 3,334,504 | 8/1967 | Moller | 72/63 |
| 3,585,829 | 6/1971 | Hurek | 72/63 |
| 3,635,061 | 1/1972 | Rydell | 72/63 |
| 3,986,379 | 10/1976 | Mansell | 72/57 |
| 4,658,618 | 4/1987 | Hellgreen | 72/63 |

FOREIGN PATENT DOCUMENTS

| | | | |
|---|---|---|---|
| 58-32525 | 2/1983 | Japan | 72/389 |
| 683835 | 9/1979 | U.S.S.R. | 72/465 |
| 1207049 | 9/1970 | United Kingdom | 72/63 |

OTHER PUBLICATIONS

"Zip–Mar" Adhesive Disks, *Premium Thick Turret Tooling*, Wilson Tool International, 1990 Edition, p. 11.

*Primary Examiner*—David Jones
*Attorney, Agent, or Firm*—Carol D. Titus; James J. Leary

[57] ABSTRACT

A combination of materials comprised of an inner or core material and an outer material layer or coating on one or both sides of the core material whereby this combination of materials is to be used in conjunction with sheet metal forming equipment such as press brake and punch press machines to protect the sheet metal and equipment tooling during the sheet metal forming process as well as improve the quality of the finished sheet metal product.

17 Claims, 6 Drawing Sheets

MATERIAL FOR PROTECTING SHEET METAL DURING THE SHEET METAL FORMING PROCESS

RELATIONSHIP WITH OTHER APPLICATIONS

This application is a continuation-in-part of application Ser. No. 08/208,974, filed on Mar. 9, 1994 now U.S Pat. No. 5,542,282, the specification of which is hereby incorporated by reference in its entirety.

FIELD OF THE INVENTION

The inventor's primary intent is that the present invention be used in conjunction with sheet metal press brake and punch press machines. More specifically, this invention involves a combination of different materials that together are placed between the sheet metal and the press brake or punch press machine tools to prevent scratching and marring of the sheet metal surface.

BACKGROUND

Sheet metal shops process sheet metal by bending and piercing the sheet metal with press brakes, punch presses, and other similar sheet metal forming machines. Typically, press brakes are hydraulic devices that utilize metal dies and metal punching tools which are shaped in such a way that when the press brake compresses the die and punch with the sheet metal in between, a particular bend or curve is formed in the sheet metal. Punch press machines, on the other hand, punch holes of various sizes and shapes in the sheet metal. To accomplish this, turret assemblies containing punching tools are positioned above the sheet metal with dies positioned below the sheet metal. With tremendous pressure, the punch press forces the punching tool downward through the sheet metal and into the die. In addition, sophisticated punch press machines have the capability to slide and rotate the sheet metal at very high speed while operating dozens of turret assemblies simultaneously.

Because both sheet metal forming methods involve metal-on-metal contact and because there is relative movement between the sheet metal and the machine surfaces and tools, it is not uncommon for the machines to scratch, gouge, or otherwise mar the surface of the sheet metal. Precoated, plated and painted sheet metal is especially susceptible to damage. With punch press machines, the punching tools and dies wear quickly, causing an increase in the clearance between the two, further resulting in rough and distorted edges around the sheet metal holes. If the application calls for highly precise holes and visually perfect bends, scratches, gouges, and rough edges are simply unacceptable. Sometimes the sheet metal machine shop is forced to deburr or smooth rough edges which adds a costly and time consuming step to the sheet metal forming process.

In recognition of this problem, some sheet metal machine shops have begun placing protective material such as paper, cloth, and plastic between the sheet metal and the sheet metal machines. Some shops coat the sheet metal with polyvinylchloride (PVC) or polyurethane film. Others coat the machine surfaces and machine tools. These materials alone have not completely eliminated the problem, and in some cases, it has actually caused additional problems.

Transference of the protective material texture is just one of the problems. Most materials have some grain or pattern associated with the surface of the material. This is especially true with woven and fibrous materials. As mentioned, press brake and press punch machines exert extremely high levels of pressure on the sheet metal. This pressure can actually transfer the grain or pattern of the protective material to the sheet metal surface. Furthermore, press brake and press punch machines are capable of moving the sheet metal around at very high speed and the use of plastic, cloth, or paper products can impede this movement. Film coatings alone, on the other hand, generally provide little protection for either the sheet metal or the tools. This is especially true when the sheet metal is harder than the tools. Typically, the tools will wear quickly and, as mentioned above, cause rough, distorted, and imprecise edges or bends. Finally, with regard to punch press machines, there are so many punching operation per minute that it is very inconvenient and time consuming to continually place and replace pieces of protective material over the appropriated sections of sheet metal.

SUMMARY OF THE INVENTION

As indicated, there are still many problems associated with the use of protective material when forming sheet metal. While co-pending patent application 08 208,974 improves the way in which sheet metal shops use protective material in conjunction with press brake machines, this invention deals with improving the protective material itself.

It is the primary objective of the present invention to provide a material that better protects the sheet metal surface thereby improving the quality and precision of the final product.

It is yet another objective of the present invention to reduce the wear and tear on the machine tools which will further improve the quality of the final product.

It is still another objective to provide a strong protective material that facilitates the movement of sheet metal over the machine tools and surfaces.

BRIEF DESCRIPTION OF THE DRAWINGS

FIG. 3. A cross-sectional view of a press brake punch and die with a layer of protective material in-between.

DETAILED DESCRIPTION OF THE PREFERRED EMBODIMENT

Figure 1A:
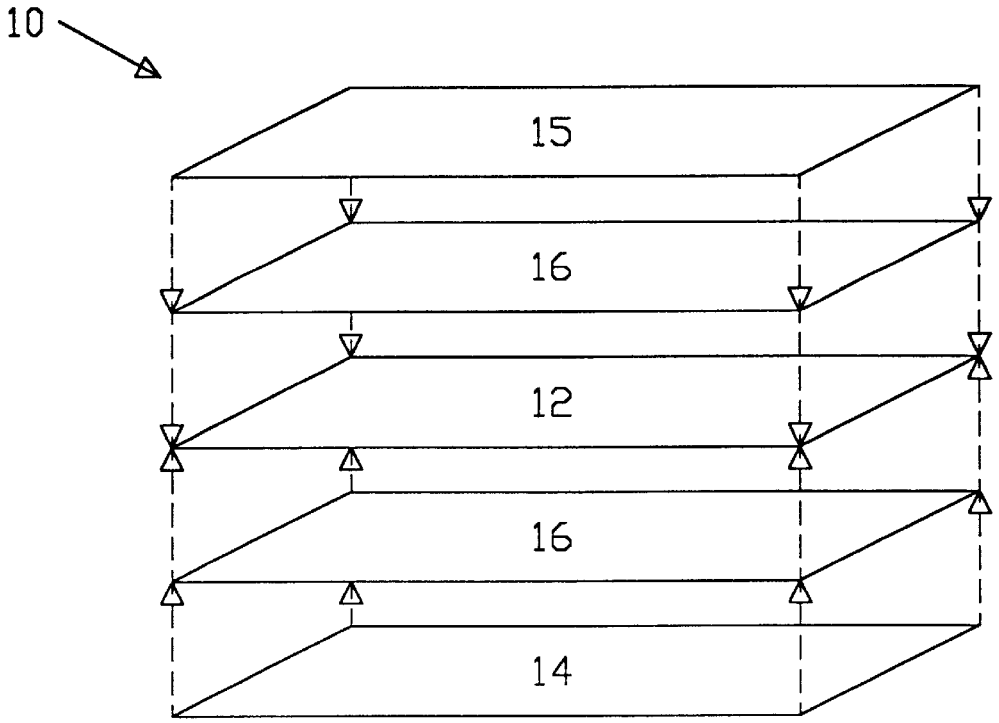
FIGS. 1A & B. Illustrate the multi-layered configuration of the preferred embodiment with both outer material layers and the core material which are bound together with an adhesive compound.

This invention describes a combination of several types of material that together provide a protective barrier 10 for sheet metal as it is being processed by press brake and punch press machines. In all cases, there is a core material 12. In most cases, an outer coating 14 or layer 20 of different material is added to the core material 12. The application will dictate whether it is beneficial to add an outer layer 14, 20 to one or both sides of the core material 12.

The application will also determine which combination of materials is appropriate. Some materials work better with certain types of sheet metal. Among the many factors one must consider in selecting the appropriate combination of materials are, of course, the type of sheet metal being processed, the hardness of that sheet metal, whether any pattern transference is acceptable, and finally economics since some materials will be more expensive to supply than others.

Figure 1B:
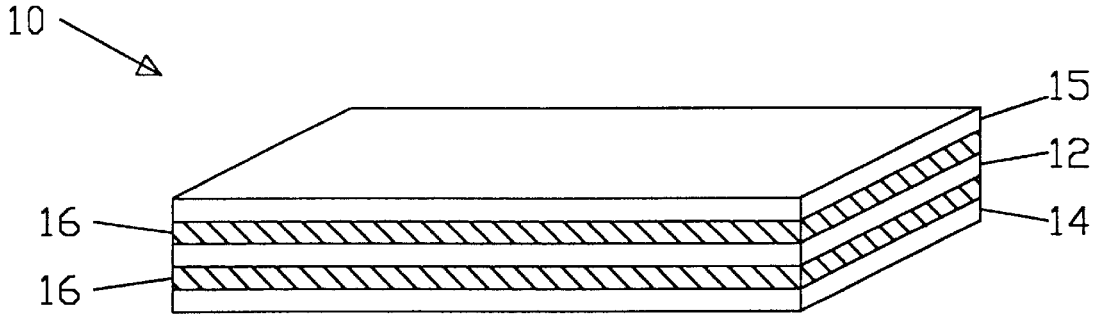
Figure 2:
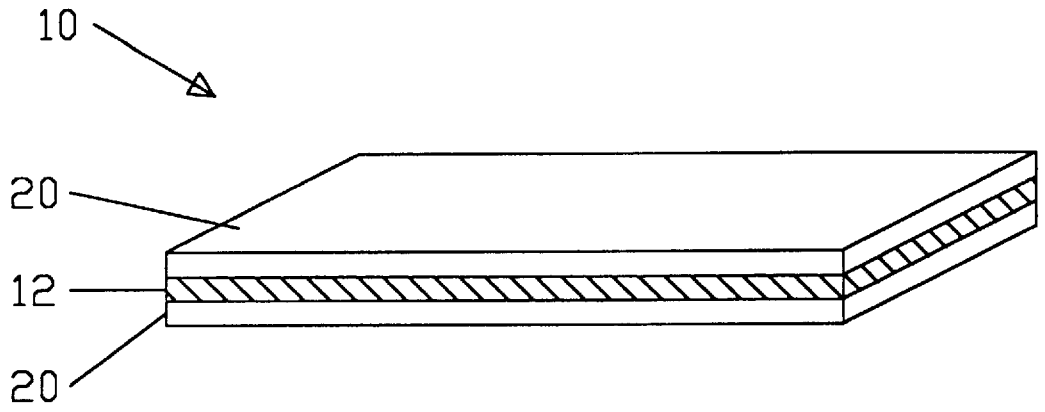
FIG. 2. Illustrates a second embodiment whereby the core material is covered on one or both sides with an outer coating.

FIG. 1A and FIG. 1B illustrate one embodiment. This embodiment involves several types of material layered together to form the protective barrier 10. The core material 12, typically, nylon, canvas, sailcloth, paper, rubber, Kevlar® or Tyvec®, is sandwiched between an upper 14 and lower 15 outer layer with adhesive compound 16 in between. The material composing the outer layers 14, 15, again depending upon the given application, is likely to be plastic, PVC, polyurethane or a teflon-based compound. Outer layers 14, 15 add strength to core material 12 as well as mask any grain or pattern inherent in that core material. Outer layers 14, 15 also facilitate the movement of the sheet metal over the machine surfaces. The core material 12 and outer layers 14, 15 are combined through a lamination process. The adhesive layers 16 bind together core material 12 and outer layers 14, 15. FIG. 2 illustrates a second embodiment, similar to the first, whereby the core material 12 is actually coated rather than laminated with a plastic or polyurethane film 20.

Figure 4:
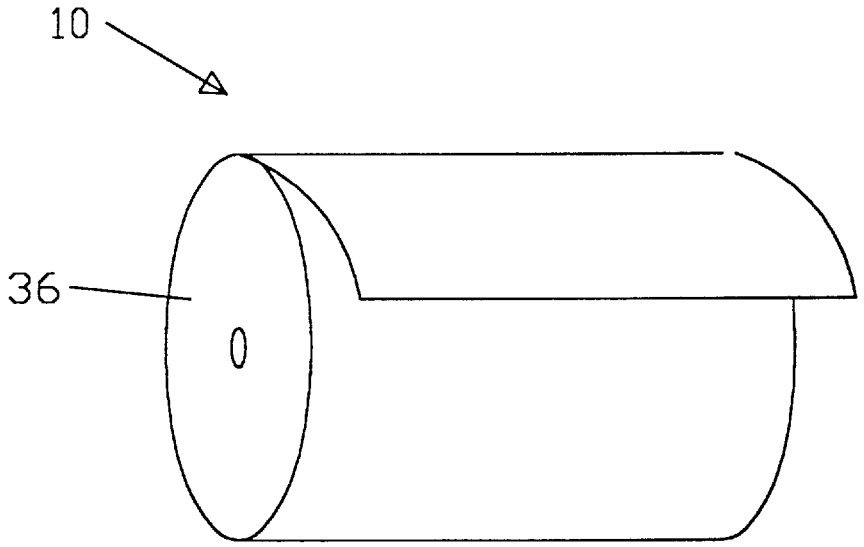
FIG. 4. A long sheet of protective material wound on a spool for use with a press brake machine.
Figure 3:
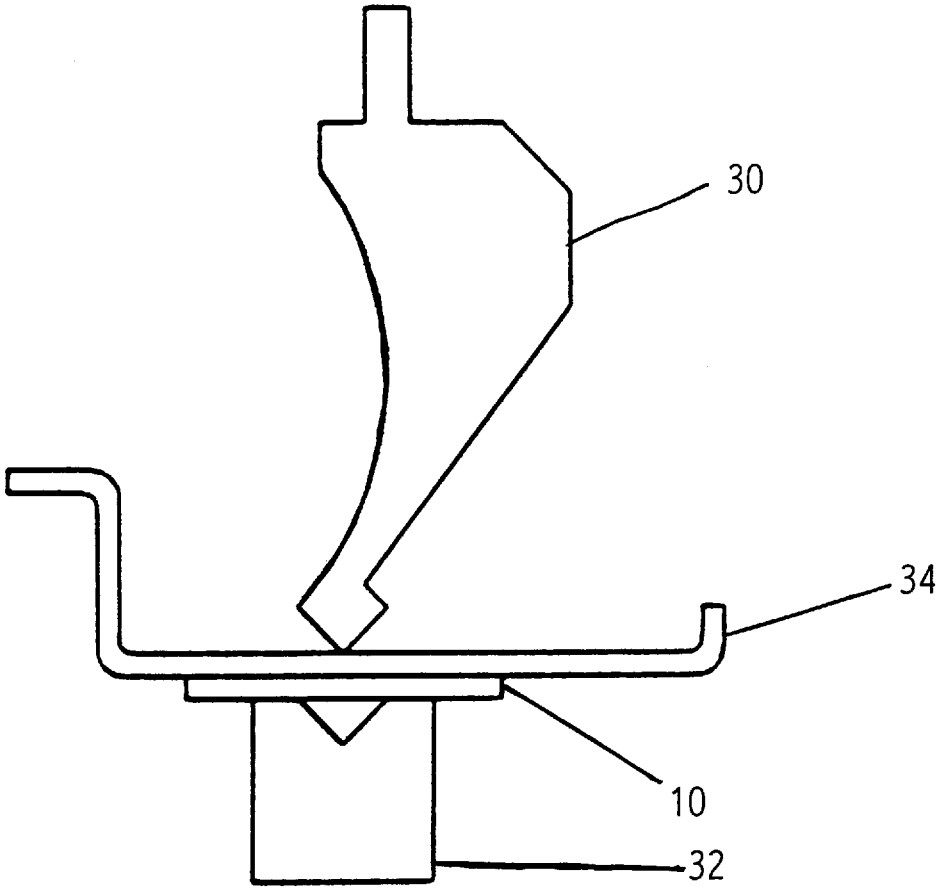

The intent is to provide this new protective material in various forms, shapes, and sizes; however, given existing sheet metal processing machinery, certain forms are more likely to be of use. FIG. 3 shows a typical press brake punch 30 and die 32 with a piece of sheet metal 34 in-between. The punch and die are actually long and narrow and the protective material is fed between the sheet metal and either the punch or the die. When using this protective material 10 with press brake type machines, it would be beneficial to provide the protective material 10 in large rolls 36, as illustrated in FIG. 4, that are easily installed on the equipment described in co-pending application 08/208,974, now U.S. Pat. No. 5,542,282. As described in this co-pending application, the spool of material 36 would be installed on spring-loaded reels that would, as necessary, feed the material through the press brake, between the punch 30 and sheet metal 34 or between the die 32 and the sheet metal 34.

Figure 5A:
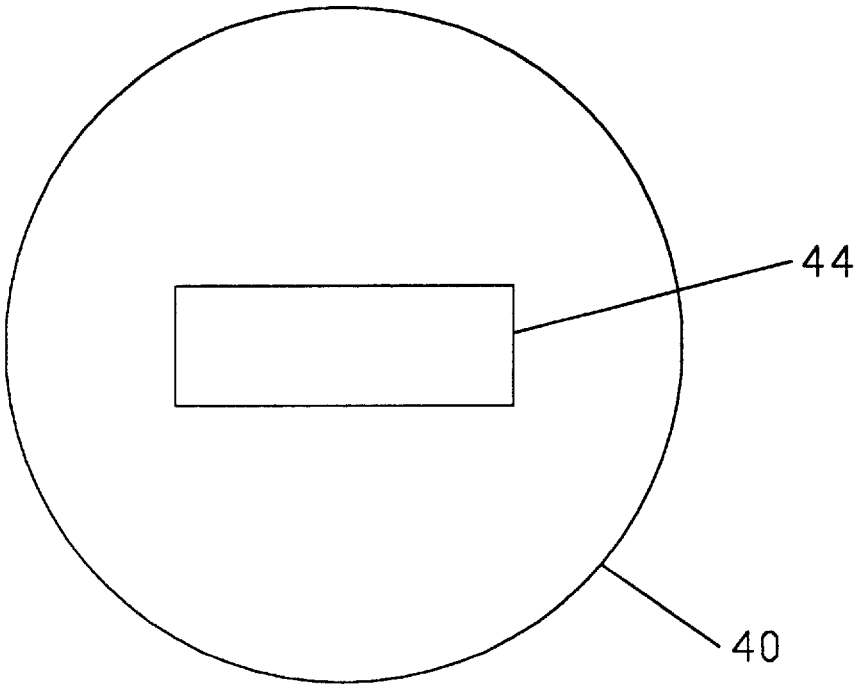
FIGS. 5A & B. Top and side views of the protective material in the form of a small disk for use with punch press equipment.
Figure 5B:
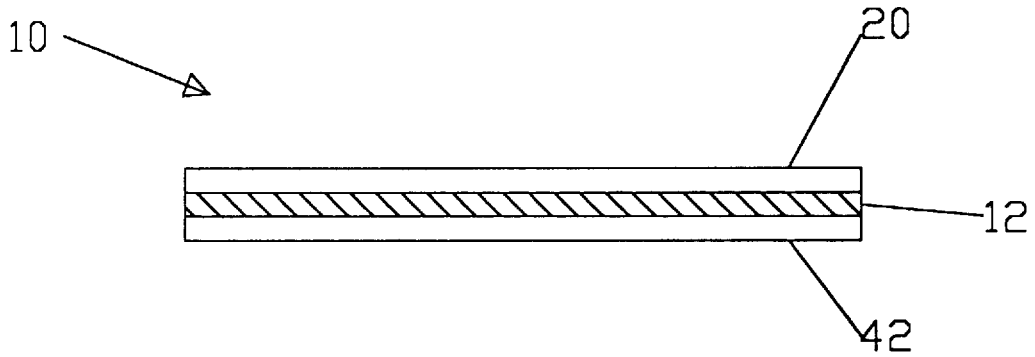
Figure 6:
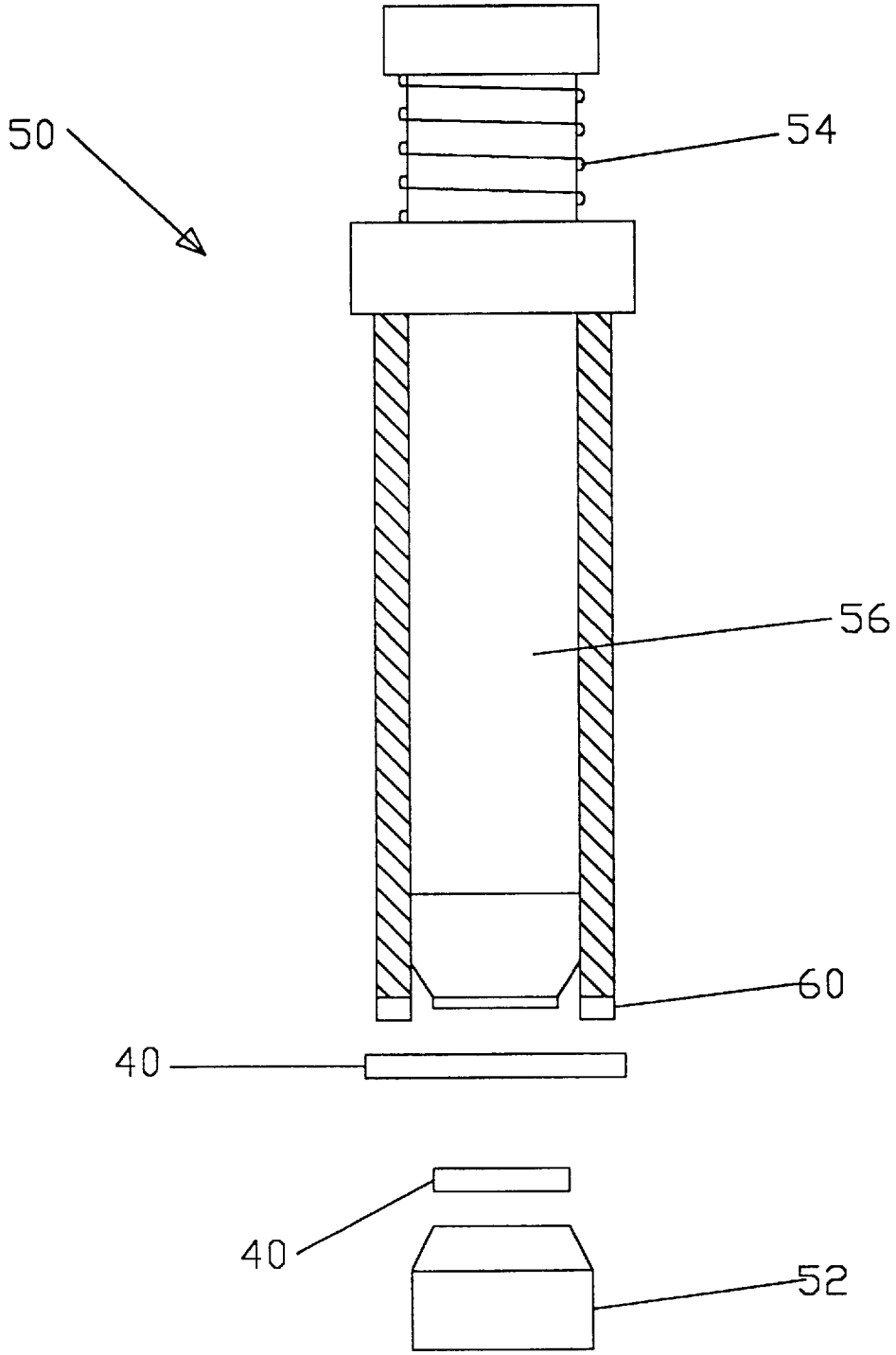
FIG. 6. A cross-sectional view illustrating how the protective material disks will attach to the die and turret assemblies of a punch press machine.

With punch press machines that are capable of punching holes of various sizes and shapes through the sheet metal, it would be more convenient to provide the material in the form of flat round disks 40 as illustrated in FIGS. 5A & B. These disks 40 would attach, with the help of an adhesive compound 42, to the bottom of the turret assembly 50 and the top of the die 52 as illustrated in FIG. 6. A turret assembly 50 is formed of a spring 54, a punch 56, a punch guide 58, and a stripper plate 60. Since the punch press machines can simultaneously employ dozens of turret assemblies 50 which operate at a very fast rate, a durable protective material that is easy to attach and remains in place for an extended period of time without requiring adjustment or replacement will save time and improve product quality. The diameter of turret assemblies 50 will of course vary according to the specific application; however, there are industry standard sizes. It would be easy to provide protective material disks 40 with diameters that match these industry standard sizes. It would also be feasible to supply disks 40 with a hole 44 pre-punched matching the shape of hole to be punched in the sheet metal. These disks 40 would be used where the shape of the punching tool matches various industry standards. For example, obround, square, rectangle, single "D", double "D", hexagon, quad "D", long "D", equilateral, and octagon. However, the disks 40 could be provided without being pre-punched, thereby allowing the punch tool to make the hole 40.

The barrier material 10 is formed by a process that begins with raw fibers . These fibers are woven into a sheet that forms the core material 12 of the barrier material 10. This sheet is then put through a finishing process. The finishing process is one of two things. The material is laminated to an outer material 14 with adhesive 16, if material of the type in FIGS. 1A & B is desired. The sheet is coated with a film 20 if the FIG. 2 material is desired. After the finishing process, the sheet is processed into the form that the end user will buy and use.

Figure 7:
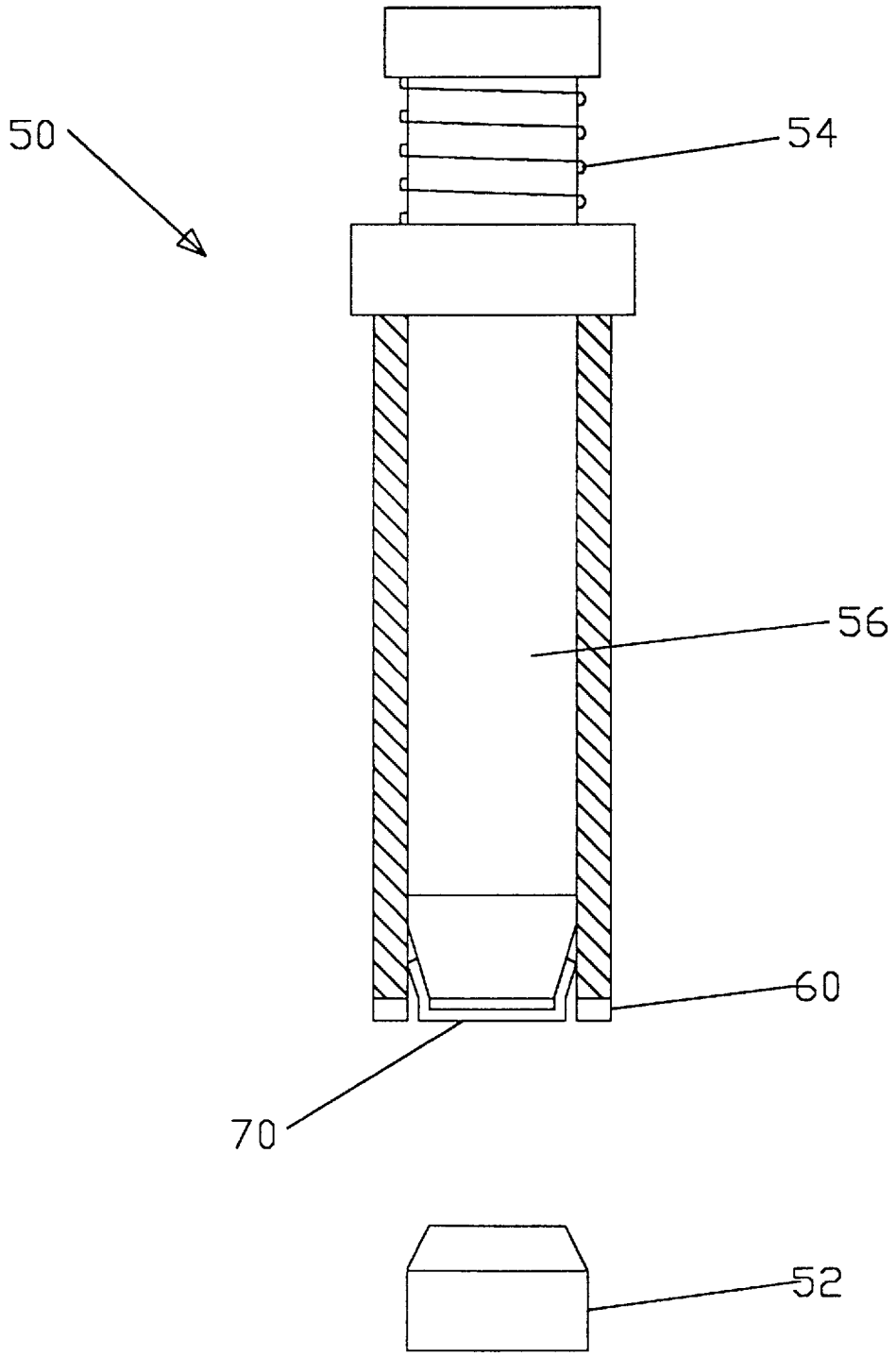
FIG. 7. A cross-sectional view illustrating how the preformed disks will attach to the turret assemblies of a punch press machine.

Preformed disks 70 of the barrier material 10, as shown in FIG. 7, could be supplied where the material is formed, for example by thermoforming, into a desired shape. A simulated die tip would be made. These simulated die tips could be formed into whatever shape the user specified. The barrier material 10 would then be formed around the simulated die tip creating a tip form that could be removed. This preformed disk 70 could then be put onto the tip of a turret assembly 50 or similar machine. These preformed disks 70 could also be used with other sheet metal forming equipment such as the press brake shown in FIG. 3. The disks 70 could be formed for the punch 30 and/or the die 32. The preformed disk 70 would then be used until worn out and replaced.

Although the examples given include many specificities, they are intended as illustrative of only one possible embodiment of the invention. Other embodiments and modifications will, no doubt, occur to those skilled in the art. Thus, the examples given should only be interpreted as illustrations of some of the preferred embodiments of the invention, and the full scope of the invention should be determined by the appended claims and their legal equivalents.

I claim:

1. In combination:

a piece of sheet metal forming equipment having a punch and a die, a protective material located at least partially between said punch and said die comprising:

a core material, and an outer material, wherein said outer material covers at least one side of said core material, and an adhesive means for binding said protective material to said piece of sheet metal forming equipment.

wherein said protective material is formed into a circular shape and precut to match a diameter chosen from a group of diameters consisting of a diameter of a turret assembly and a diameter of the die and wherein said protective material directly adheres to a surface chosen from a group of surfaces consisting of a bottom of said turret assembly and a top of the die with said adhesive means.

2. The combination of claim 1 further comprising an adhesive means for binding said outer material to said core material.

3. The combination of claim 1 wherein said core material is comprised of a material selected from a group of materials consisting of nylon, canvas, sailcloth, paper, rubber, Kevlar®, and Tyvek®.

4. The combination of claim 1 wherein said outer material is comprised of material selected from a group of materials consisting of plastic, polyvinylchloride (PVC), polyurethane and teflon-based compounds.

5. The combination of claim 1 wherein said protective material is located between said sheet metal forming equipment and a piece of sheet metal so as to provide a protective barrier.

6. The combination of claim 1 wherein said punch and said die are formed of a rigid material.

7. The combination of claim 6 wherein said rigid material is metal.

8. In combination:

a piece of sheet metal forming equipment having a punch and a die, a protective material located at least partially between said punch and said die comprising:

a core material, and an outer material, and a means for positioning said protective material between said piece of sheet metal forming equipment and a piece of sheet metal, wherein said outer material covers at least one side of said core material, and wherein said means for positioning further comprises a means for incrementally advancing said protective material with respect to at least one of said punch or said die.

9. The protective material of claim 8 wherein said sheet metal forming equipment is a press brake.

10. The protective material of claim 8 further comprising an adhesive means for binding said outer material to said core material.

11. The protective material of claim 8 wherein said core material is comprised of a material selected from a group of materials consisting of nylon, canvas, sailcloth, paper, rubber, Kevlar®, and Tyvek®.

12. The protective material of claim 8 wherein said outer material is comprised of material selected from a group of materials consisting of plastic, polyvinylchloride (PVC), polyurethane and teflon-based compounds.

13. A method of protecting a piece of sheet metal during a metal working process comprising the steps of:

a) laminating at least one material to form a multilayer protective material;

b) placing said protective material between a piece of sheet metal forming equipment having a tool and a die and a piece of sheet metal;

c) forming said piece of sheet metal with said piece of sheet metal forming equipment with said protective material between said piece of sheet metal forming equipment and said piece of sheet metal, wherein said protective material is formed in a circular shape and precut to match a diameter chosen from a group of diameters consisting of a diameter of a turret assembly and a diameter of the die and wherein said protective material directly adheres to a surface chosen from a group of surfaces consisting of a bottom of said turret assembly and a top of the die with said adhesive means.

14. The method of claim 13 wherein said material is laminated by placing an adhesive between a core material and an outer material.

15. The method of claim 13 wherein said material is laminated by coating a core material with an outer material.

16. The protective material of claim 13 wherein said at least one material is a core material and an outer material and said core material is comprised of a material selected from a group of materials consisting of nylon, canvas, sailcloth, paper, rubber, Kevlar®, and Tyvek®.

17. The protective material of claim 13 wherein said at least one material is a core material and an outer material and said outer material is comprised of material selected from a group of materials consisting of plastic, polyvinylchloride (PVC), polyurethane and teflon-based compounds.

* * * * *